US008002033B2

(12) United States Patent
Calderon et al.

(10) Patent No.: US 8,002,033 B2
(45) Date of Patent: Aug. 23, 2011

(54) METHOD FOR RECOVERING ENERGY IN-SITU FROM UNDERGROUND RESOURCES AND UPGRADING SUCH ENERGY RESOURCES ABOVE GROUND

(76) Inventors: Albert Calderon, Bowling Green, OH (US); Terry James Laubis, Portage, OH (US)

( * ) Notice: Subject to any disclaimer, the term of this patent is extended or adjusted under 35 U.S.C. 154(b) by 277 days.

(21) Appl. No.: 12/380,669

(22) Filed: Mar. 3, 2009

(65) Prior Publication Data

US 2010/0224369 A1 Sep. 9, 2010

(51) Int. Cl.
*E21B 43/24* (2006.01)
*E21B 43/243* (2006.01)

(52) U.S. Cl. ..... 166/257; 166/260; 166/261; 299/2

(58) Field of Classification Search ..... 166/256, 166/257, 260, 261, 262; 299/2
See application file for complete search history.

(56) References Cited

U.S. PATENT DOCUMENTS 4,089,372 A * 5/1978 Terry ..... 166/256
4,457,374 A * 7/1984 Hoekstra et al. ..... 166/250.15
4,614,234 A * 9/1986 Puri ..... 166/261
4,927,430 A * 5/1990 Calderon ..... 48/197 R
5,356,530 A * 10/1994 Calderon ..... 208/108
6,016,868 A * 1/2000 Gregoli et al. ..... 166/261
6,911,058 B2 * 6/2005 Calderon et al. ..... 48/197 R
7,413,647 B2 * 8/2008 Calderon et al. ..... 208/108
7,624,801 B2 * 12/2009 Zubrin et al. ..... 166/250.15
7,650,939 B2 * 1/2010 Zubrin et al. ..... 166/266
7,654,330 B2 * 2/2010 Zubrin et al. ..... 166/369
7,810,565 B2 * 10/2010 Zubrin et al. ..... 166/266
2006/0054318 A1 * 3/2006 Sarada ..... 166/266
2008/0053655 A1 * 3/2008 Retallick et al. ..... 166/260
2010/0037667 A1 * 2/2010 Calderon et al. ..... 71/24

* cited by examiner

*Primary Examiner* — William P Neuder
*Assistant Examiner* — Catherine Loikith

(57) ABSTRACT

This method deals in recovering energy in-situ from an underground resource and upgrading such resource above ground. It consists of injecting a hot gas to pyrolyze it to produce gases and liquids with high hydrogen content and a residual hot char. The gases and liquids together with the injected hot gas form a mixture of gases and liquids that is brought above ground and treated into a clean mixture of gases and liquids rich in hydrogen and then used as a chemical feedstock and/or transportation fuel. Following the pyrolyzation of the resource, carbon dioxide and air are injected into the residual hot char to convert the $CO_2$ into $2CO+N_2$, which is brought above ground and treated into a clean lean gas. This lean gas is used to generate efficient electric power, heat the injected gas for pyrolysis, and convert the $2CO+N_2$ as a feedstock into fertilizer.

20 Claims, 3 Drawing Sheets

FLUE GAS
$N_2$,$CO_2$
AIR
WATER
STEAM
LEAN GAS
SULFUR
COAL LIQUIDS OR SHALE CRUDE
GAS
INJECTION PIPE

AIR
WATER
STEAM
LEAN GAS
SULFUR
FLUID BITUMEN
HEAVY NAPHTHA
LIGHT OIL
ATMOSPHERIC GAS OIL
RESIDUUM
LIGHT NAPHTHA
INJECTION PIPE
GAS

METHOD FOR RECOVERING ENERGY IN-SITU FROM UNDERGROUND RESOURCES AND UPGRADING SUCH ENERGY RESOURCES ABOVE GROUND

INTRODUCTION

The method disclosed herein relates to the recovery of energy from underground resources such as all types of coal, oil shale, oil sands, and the like, wherein the resources are in a solid or semi-solid state. This method comprises two separate and distinct steps practiced underground and the rest of the steps above ground. The first step consists of underground pyrolysis to devolatilize the resource, and the second step which follows after the pyrolysis step consists of reducing carbon dioxide ($CO_2$) into carbon monoxide (CO) by making use of hot carbon in the form of char left over as a residue from the first step.

Specifically, the first step resides in first pyrolyzing the resources underground in-situ by means of a preheated, preferably, non-condensable, recycling gas in order to recover from the resources, via devolatilization, very valuable volatile matter containing hydrogen ($H_2$) rich gases and liquids by injecting said hot recycling gas, which was preferably, preheated above ground, into the seams of said resources to cause the release of said gases and liquids by conduction, convection and radiation but not by combustion of the resources during devolatilization, in order to prevent the degradation of said gases and liquids. These gases and liquids together with said recycling gas are subsequently brought above ground for upgrading them to valuable by-products in the form of chemicals that can be synthesized into various products, while leaving behind in the ground carbon in the form of a porous, reactive seam of hot char.

As a second step, this hot char serves as a reductant for the conversion of injected greenhouse gases such as a flue gas containing $CO_2$, a waste greenhouse gas, into said hot char and converting the $CO_2$ into CO which is a valuable gas made from a waste greenhouse gas and which is brought above ground independently following the pyrolysis step of extracting the $H_2$ rich gas. This CO gas can be used for various applications, such as a chemical feedstock or a fuel. Since the conversion of $CO_2$ into CO is endothermic, an oxidant in the form of air or oxygen is injected individually or in combination with the flue gas which generally contains $CO_2$ and nitrogen ($N_2$) into the porous, reactive hot char to convert some of the char into thermal energy in order to maintain the temperature at which the conversion of the $CO_2$ to CO can take place.

In the case where $N_2$ is present in the flue gas, the newly formed CO would also contain $N_2$, thus producing a low-Btu fuel gas (lean gas made up of $N_2$+CO) which, after it is brought above ground and cleaned, makes an excellent fuel for the generation of electric power especially by means of gas turbines tied to generators while forming low oxides of $N_2$ and at the same time contributing mass to the turbine which improves power generation efficiency. This lean gas can also be used to preheat the recycling gas, and also to make a fertilizer by virtue of its $N_2$+CO content.

BACKGROUND

Conventional underground mining wherein people and equipment are lowered underground via a mine shaft is perilous and unhealthy; in addition, many energy resources are imbedded too deep in the ground, making them inaccessible to manpower and to mining equipment. The advantages of pyrolyzing a resource such as coal underground in-situ are several. The main advantage is the recovery of volatile matter containing a $H_2$ rich gas which is most suitable for many valuable applications. Some of the other advantages comprise the elimination of costly surface mining, the elimination of men and machines lowered underground to perform the dangerous operation of digging the resource, reaching valuable and abundant energy resources that are inaccessible, essentially doing away with surface damage to land, drastically reducing the production of pollutants, and saving lives.

One method of in-situ gasification of coal, known as Underground Coal Gasification, comprises the conversion of the coal into gases by making use of underground combustion wherein the very valuable volatile matter in the coal is burned with the carbon, resulting in a poor quality gas. Some other disadvantages of such underground coal gasification using combustion present the following problems;

- Poor quality recovered gas by virtue of high $N_2$ and low $H_2$ content;
- Groundwater contamination;
- Excessive cavity temperatures;
- Unsteady state, making it difficult to control;
- Wide thermal gradients;
- Land subsidence in case of shallow resource seams; and
- Underground generation of greenhouse gas such as $CO_2$.

OBJECTIVES

With the advantages of the instant invention and the disadvantages of the process which uses combustion mentioned above, the main object of this invention is to recover energy in-situ from an underground energy resource seam by means of a low-cost, controllable, pressurized hot recycling gas which is heated above ground and injected into said underground resource to efficiently devolatilize the resource in an environmentally acceptable manner to co-produce a very valuable $H_2$ rich gas and a bed of residual hot char, said hot recycling gas preferably, being derived from the resource itself and being adapted to be injected in the resource seam subsequently to its preheat.

Another object of the instant invention is to utilize said residual hot char as a reducing agent to cause the reduction of $CO_2$ which is considered to be a greenhouse gas that is generated above ground, into CO by injecting said $CO_2$ together with an oxidant such as air or oxygen individually or in combination through said bed of residual hot char, to furnish the thermal energy which is necessitated to raise the temperature of said char to such an extent as to compensate for the endothermic reaction that takes place when $CO_2$ is reduced to CO.

Still another object of the present invention is to provide a low-cost, above-ground, efficient system for the upgrading of said $H_2$ rich gas extracted from the underground energy resource seam.

Yet another object of the present invention is to clean up said $H_2$ rich gas and synthesize it into valuable chemicals and/or liquid transport fuels.

Further another object of the present invention is to utilize a portion of the CO resulting from the reduction of said $CO_2$ as a fuel to preheat said recycling gas above ground.

Therefore another object of the present invention is to utilize a portion of the CO resulting from the reduction of said $CO_2$ to generate electric power above ground.

Further still another object of the present invention is to utilize CO resulting from the reduction of said $CO_2$, to convert it into a fertilizer.

Further yet another object of the present invention is to provide separate suction means within the resource bed to collect gases, including water vapor originating from aquifers, if any, in order to prevent groundwater contamination.

It is therefore another object of this instant invention to apply two steps in the recovery of energy from underground resources by means of two independent steps which are carried out sequentially, the first step comprising the pyrolyzing of the resource with a hot gas to produce volatile matter and a hot char, and the second step comprising the utilization of the hot char for the reduction of greenhouse gases such as $CO_2$ gas into CO.

Other objects of the instant invention will become apparent to those skilled in the art to which this invention pertains, particularly from the following description and appended claims.

Reference is now made to the accompanying drawings which form a part of this specification wherein like reference characters designate corresponding parts. It is to be understood that the embodiments shown herein are for the purpose of description and not for limiting the scope of the invention.

DETAILED DESCRIPTION OF THE DRAWINGS

Figures 1, 2:
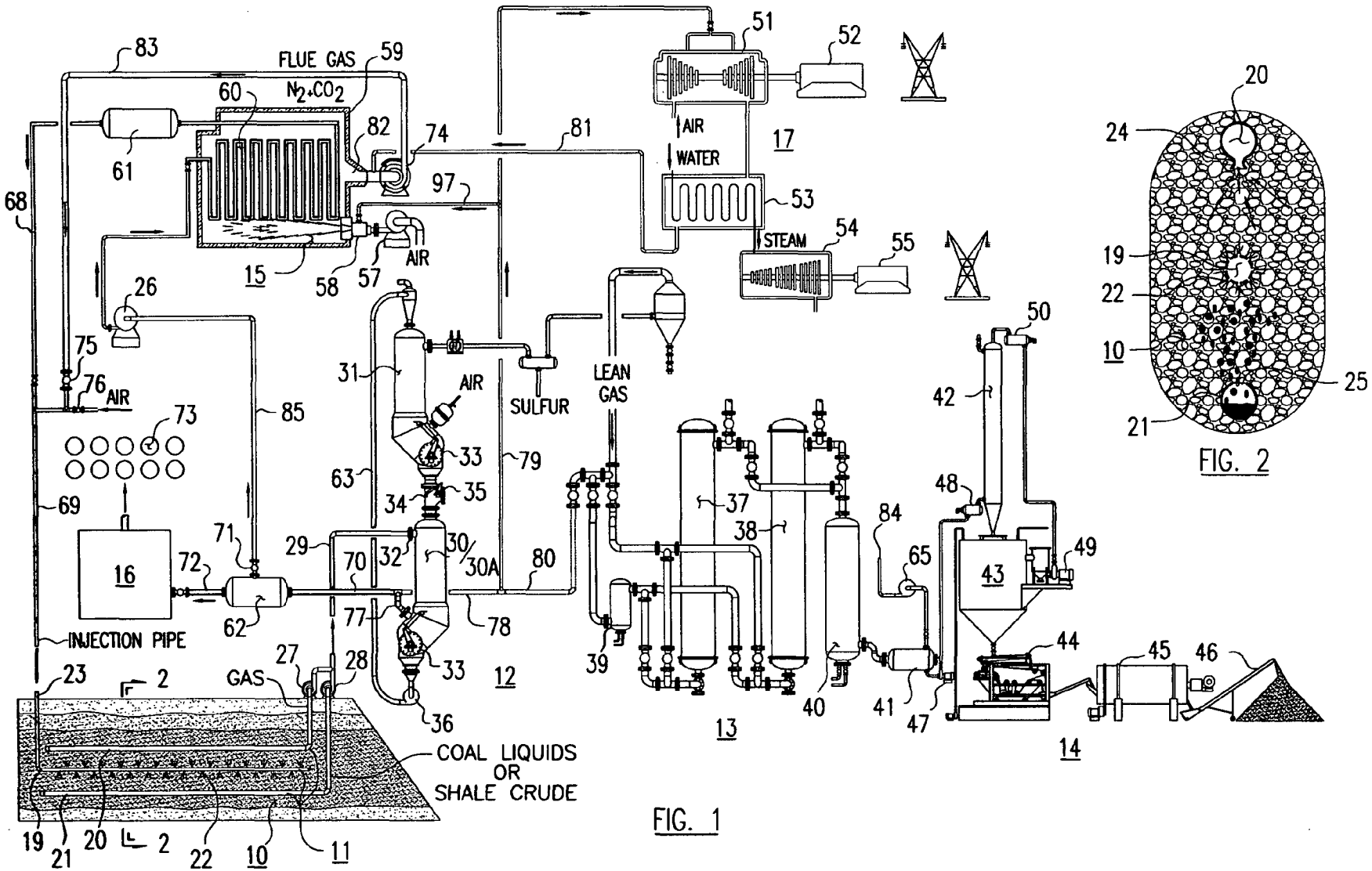
FIG. 1 is a flow diagram which illustrates various components to carry out the steps to achieve the objects of this invention and by way of example using coal or shale as the underground resource through which horizontal directional drilling had been implemented to accommodate the piping system for the injection of the gases and the collection of raw products from the resource.
FIG. 2 is a section through the resource taken at 2-2 of FIG. 1. This section illustrates that the resource was rubblized to provide passages through the resource and being in the process of devolatilization of the resource as the first step of the instant method.

Referring to FIG. 1, numeral 10 represents the underground resource seam from which energy in the form of gases and liquids is recovered, and numeral 11 represents the underground piping system for injection and collection. A gases and liquids cleanup-upgrader is represented by numeral 12; numeral 13 represents a cyanogen complex; numeral 14 represents the oxamide fertilizer maker; and numeral 15 is a recycle gas heater. Numeral 16 is a complex for making chemicals, one of which is methanol which can be converted to gasoline or dimethyl ether, and numeral 17 represents a combined cycle electric power plant. The facilities represented by numerals 12 through 17 are cumulatively constructed above ground.

Referring again to underground resource seam 10, shown in FIG. 1 and FIG. 2, and by way of example assuming that it is a coal seam, piping system 11 is provided to effect the underground processing. This system is comprised of injection pipe 19 and extraction pipes 20 and 21, with injection pipe 19 being interposed between pipe 20 and pipe 21. Even though pipes 19, 20, and 21 are shown at a right angle (from a vertical position into a horizontal position), in reality they follow horizontal directional drilling practice (which is a known art in the petroleum industry) to enable a gradual bent configuration following a mild curve to change from a vertical position to a horizontal position. Injection pipe 19 is equipped with a plurality of injection nozzles denoted by numeral 22 disposed along the length of pipe 19 as well as its circumference, as clearly shown in FIG. 2. This approach enables the injection of a hot gas under pressure in many directions to cover as much surface area as possible in order to provide a most efficient heat-transfer condition for the devolatilization of the coal. Pipe 20 which is under suction is configured as shown in FIG. 2 with an open slot denoted by numeral 24 to evacuate gases while devolatilizing the coal. Slot 24 along the length of pipe 20 is preferably composed of several smaller slots disposed linearly in series along the length of the pipe. With respect to pipe 21 which serves to collect liquids is configured in such a way that liquids such as tar and light oils would flow downward as shown in FIG. 2, with a series of slots configured along its length and denoted by numeral 25. It is to be noted that pipe 20 has its slots at the bottom of its circumferential perimeter, and pipe 21 has its slots at the top of its circumferential perimeter.

The dynamics of injection by means of pipe 19 of a hot gas and suction by pipes 20 and 21 are effected above ground as follows: For injection of the hot gas into pipe 19, a compressor denoted by numeral 26 is provided; for the suction of gases, compressor 27 is provided; and for the extraction of the liquids, pump 28 is provided. Both compressor 27 and pump 28 merge above ground and are jointly directed to cleanup-upgrader 12 using conduit 29.

Cleanup-upgrader 12 is made up of two vessels, marked by numeral 30 and 31, with vessel 30 serving as a cracker/desulfulizer by means of a hot sorbent wherein the mixture of the sulfidated gases and liquids, including the recycled injection gas, enters the top of vessel 30 via port 32. Vessel 31 serves as a regenerator to regenerate and decarbonize the sulfidated, carbon-impregnated sorbent. Both vessels 30 and 31 are equipped with feeders denoted by numeral 33. Vessel 31 interconnects with vessel 30 via duct 34, which is equipped with valve 35 to control the flow of the regenerated, hot sorbent from vessel 31 into vessel 30. Cleanup-upgrader 12 is equipped with pneumatic transporter 36 to convey the spent sorbent via pipe 63 from the bottom of cracker/desulfulizer 30 to the top of regenerator 31.

Cyanogen complex 13 comprises reactors 37 and 38, with temperature moderator denoted by numeral 39 and a chiller which is denoted by numeral 40 located downstream of reactor 38 which in turn is followed by liquefier-separator 41 whose function is to separate the liquefied cyanogen from the unreacted gases which are recycled into vessel 37 or 38 by means of compressor 65 using duct 84.

Downstream of liquefier-separator 41, oxamide maker 14 is located. It consists of reactor 42, settling tank 43, filter press 44, drier 45, and stacker 46. Pump 47 is provided to separator 41 to pump liquefied cyanogen to evaporator 48, and pump 49 serves to circulate the liquid catalyst to the top of reactor 42; a heater denoted by numeral 50 serves to adjust the temperature of the liquid catalyst.

Referring to recycle gas heater 15, it consists of air fan 57, burner 58, turbo-blower 74, internal piping 60, and hot recycle gas accumulator 61. Heater 15 is housed in an enclosure denoted by numeral 59. Referring to complex 16, it comprises gas cooler 62 and splitter valve 71 which divides the cleaned and upgraded $H_2$ rich gas into two streams, one stream to become the recycle gas which is ducted by means of conduit 85 to compressor 26 and the other stream as the feedstock for chemical complex 16 which is ducted by means of conduit 72 to complex 16. Complex 16 comprises a synthesis facility which is known in the art of converting $H_2$ rich gas (syngas) into chemicals such as methanol that can be used as is or synthesized into by-products including gasoline or dimethyl ether. Referring now to power plant 17, which represents a combined cycle configuration, consists of gas turbine 51, electric generator 52, heat recovery steam generator 53, steam turbine 54, and electric generator 55. FIGS. 1 and 2 and their detailed description essentially relate to the processing of coal and shale.

Figures 3, 4, 5:
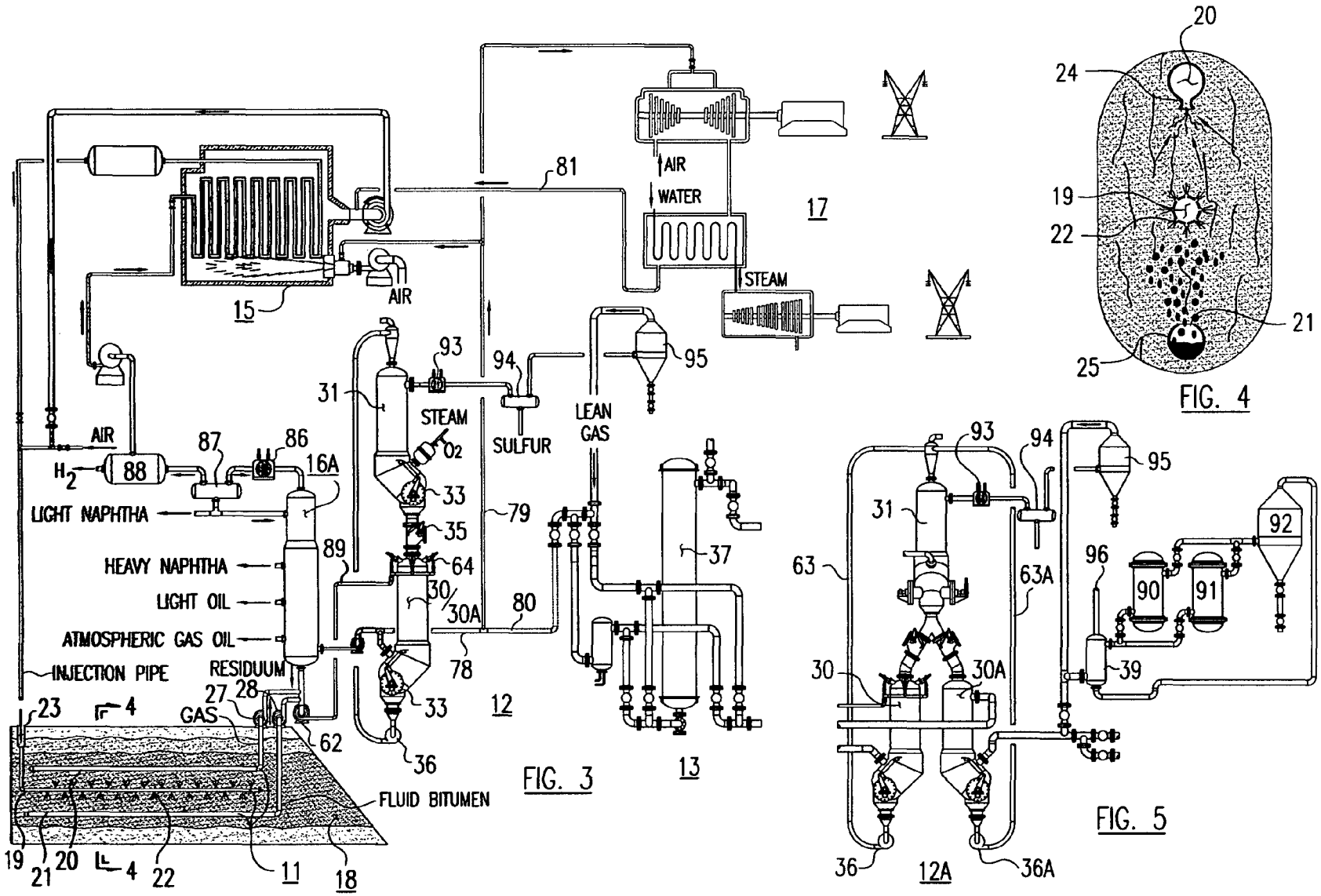
FIG. 3 is a flow diagram which is similar to FIG. 1, except it represents an arrangement as applied to the recovery of bitumen from oil sands or like material.
FIG. 4 is a section through the oil sand taken at 4-4 of FIG. 3. This section illustrates that the resource possesses fissures to provide passages through the resource.
FIG. 5 is an alternate cleaner-upgrader wherein three vessels are provided: The first vessel to treat the $H_2$ rich gas, the second vessel to treat the lean gas, and the third vessel to act as a common regenerator.

Referring now to FIGS. 3 and 4, which relate to the recovery of bitumen such as from an oil sand resource, numeral 18 represents the oil sands seam; 11 is the underground piping system; the cleanup-upgrader for the gases and liquids is represented by numeral 12; numeral 13 represents the cyanogen complex in part; and numeral 14, representing the oxamide fertilizer maker, is not shown but by reference can be seen in FIG. 1. Numeral 15 is the recycle gas heater. Numeral 16A is a fractionator, which replaces the complex for making chemicals 16 shown in FIG. 1. It is to be noted that cleanup-upgrader 12, cyanogen complex 13, oxamide maker 14 (not shown), recycle gas heater 15, and electric power plant 17 are the same as those shown in FIG. 1; therefore, detail numerals for these various common components are not shown in FIG. 3 in order to obviate redundancy. A fractionator marked by the numeral 16A is a vessel known in the oil refinery industry as a vessel wherein various condensable fractions are extracted. The non-condensable gas is ducted to heat exchanger 86, thence to proportionator 87 and separator 88 where $H_2$ may be extracted. The products from the fractionator can be several fractions, some of which are light naphtha, heavy naphtha, light oil, atmospheric gas oil, and residuum. A collection pump represented by numeral 62 serves to gather $H_2$ rich gases, and liquids extracted from underground seam 18 together with residuum from the bottom of fractionator 16A, and by means of conduit 89 these fractions are delivered as a mixture to an injection manifold denoted by numeral 64 disposed to vessel 30 of cleanup-upgrader 12.

Referring to FIG. 5, an alternate cleaner-upgrader is shown which is marked by numeral 12A wherein three reactor vessels are provided: namely, vessel 30 to treat raw $H_2$ rich gas and liquids recovered in Phase 1; vessel 30A to treat raw lean gas recovered from Phase 2 and vessel 31, a common regenerator to regenerate the sorbent with elemental sulfur being released in vapor form which is cooled in heat exchanger 93 and collected in condenser 94. The non-condensable gas (a lean gas) is directed to cyclone 95 for particulate removal.

With respect to the removal of mercury, a pair of activated carbon beds, which alternate, is provided and marked by numerals 90 and 91 through which gas from cyclone 95 is passed through either bed 90 or bed 91 to capture mercury. Downstream of activated carbon beds 90 and 91, a baghouse marked by numeral 92 is disposed to trap any carbon particles from bed 90 or 91. The filtered gas from baghouse 92 leaves via duct 96 to either power plant 17, cyanogen complex 13, or heater 15.

Figures 6, 7:
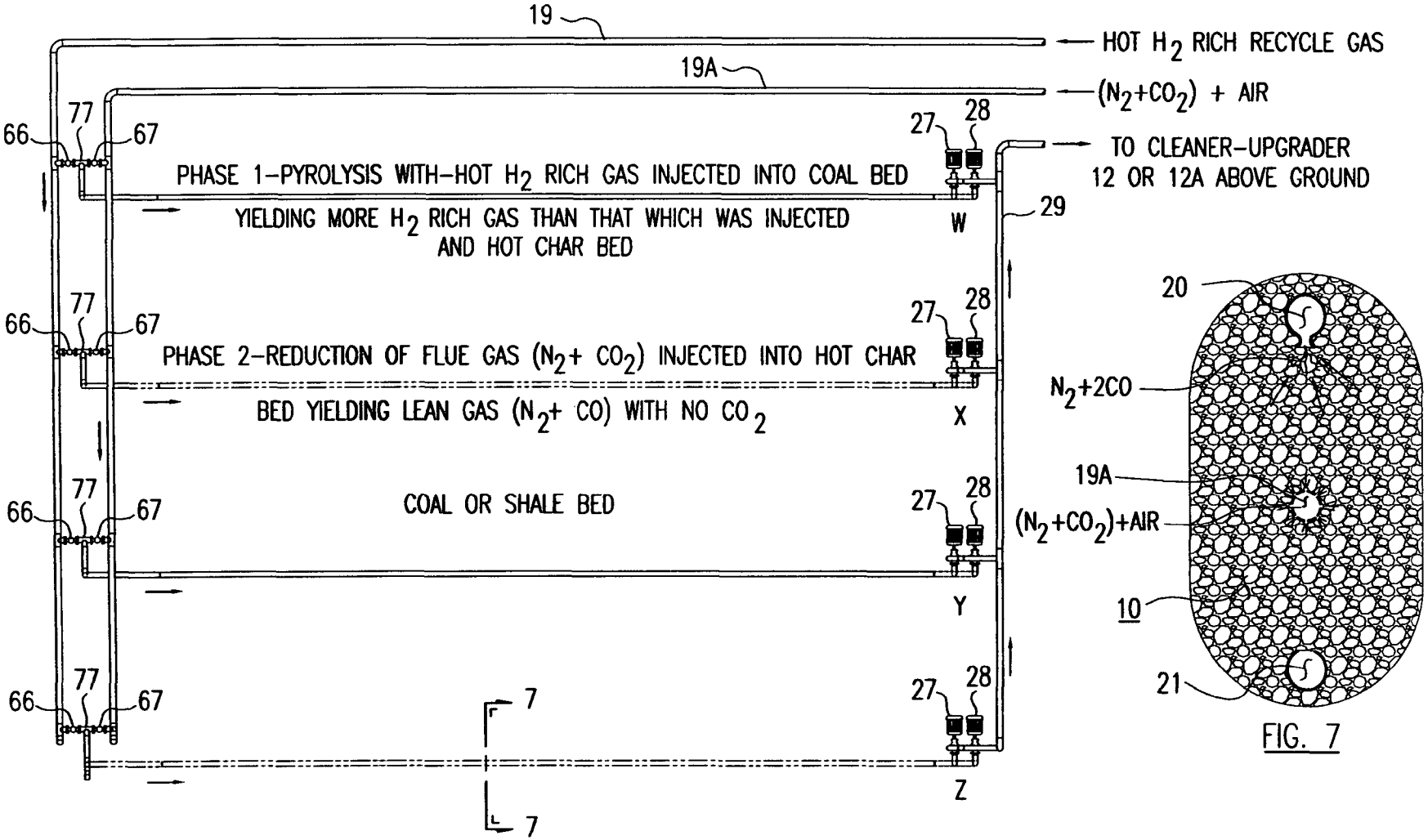
FIG. 6 is a plan view representing a piping system to indicate a multiplicity of an injection and collection configuration as it would be applied as a replicable approach in an underground energy recovery field.
FIG. 7 is a section through the resource taken at 7-7. It represents the reduction of $CO_2$ contained in a flue gas ($N_2$+$CO_2$) into $N_2$+2CO as the second step of the instant method.

Referring to FIG. 6, it is a plan view of a small portion of an underground energy field and is represented by four sections and consecutively marked by letters "W," "X," "Y," and "Z" with sections "W" and "Y" (shown in solid lines) being in the pyrolysis step (Phase 1) and sections "X" and "Z" (shown in phantom lines) being in the $CO_2$ reduction step (Phase 2). A gas feeding directional system denoted by numeral 77, which is composed of two direction valves marked by numerals 66 and 67, provides the capability to switch from Phase 1 to Phase 2 with injection pipe 19 injecting hot $H_2$ rich recycle gas for pyrolysis and with injection pipe 19A injecting the flue gas ($N_2$+$CO_2$)+air. The outlet of exhauster 27 and pump 28 merge to form a collection pipe. This collection pipe which is denoted by numeral 29 is the above ground conduit that feeds the gases and liquids to cleanup-upgrader 12A for the treatment of raw $H_2$ rich gas through vessel 30 as well as for the treatment of raw lean gas through vessel 30A, shown in FIG. 5. It is to be noted that FIG. 2 and FIG. 7, which look alike, are the same, except that FIG. 2 is in Phase 1 and FIG. 7 is in Phase 2.

Operation as Applied to Recovery from Coal or Shale

By way of example, the operation will be herein described using coal as the underground resource which is also applicable to the recovery of energy from underground shale, with the exception that in the case of using coal a high temperature of recycle gas is used and in the case of shale an intermediate temperature is utilized. Referring to FIGS. 1 and 6, and assuming the process is running at steady state with respect to Phase 1, hot $H_2$ rich gas which serves as a thermal energy carrier from accumulator 61 that is located downstream of recycle gas heater 15, is delivered by means of conduits 68 and 69 to enter coal seam 10 at point 23. This hot recycle gas may be any gas, but preferably comprises a portion of the $H_2$ rich gas recovered from the pyrolysis of the resource.

Piping system 11 comprises three pipes; namely, pipes 19, 20, and 21. The hot $H_2$ rich recycle gas which is injected into coal seam 10 performs the devolatilization by means of pipe 19 that is equipped with a multiplicity of nozzles marked by numeral 22 along its length to efficiently devolatilize the coal by virtue of the hot $H_2$ rich recycle gas being at a temperature above the devolatilization temperature of the coal. The gases produced are sucked by pipe 20 which preferably is located above pipe 19 as shown in FIG. 2. The coal liquids which flow downwardly are collected by means of pipe 21 which is also under suction and is located below pipe 19 as also shown in FIG. 2. Exhauster 27 and pump 28, which are located above ground, serve to extract both the newly produced $H_2$ rich volatile matter via the devolatilization of seam 10 together with the $H_2$ rich recycle gas injected into seam 10, and to deliver them to the above-ground cleanup-upgrader 12 using conduit 29.

The volatile matter which is the product of devolatilization is made up of several gases, but the dominant gas is $H_2$ and therefore characterized as a $H_2$ rich gas. While such devolatilization is occurring, a hot char is co-produced which is used as a carbon source for the conversion of greenhouse polluting gases such as $CO_2$ into CO, or $SO_2$ into elemental sulfur, or $NO_X$ into elemental $N_2$ in Phase 2 which follows after the completion of the devolatilization of the resource in Phase 1.

The cleanup and upgrading of the gases and liquids recovered via pyrolysis from the coal and brought above ground as a raw $H_2$ rich gas containing a mixture of various gases such as $H_2$, CO, $CH_4$, $H_2S$, and hydrocarbons like tars and light oils, is fed to the top of cracker/desulfurizer 30 and exposed to a hot, sulfur-absorbing sorbent to crack liquids and hydrocarbons contained in said raw $H_2$ rich gas to deposit carbon on the sorbent while simultaneously desulfurizing the raw gas to result in: (i) a cleaned, desulfurized $H_2$ rich gas (a syngas) virtually devoid of hydrocarbons and sulfur in the case of the recovery of energy from coal, and (ii) a carbon-impregnated sulfidated sorbent. In the case of the recovery of energy from shale wherein an intermediate temperature is utilized, the objective is to desulfurize but to include condensable hydrocarbons in the gas, as oil from shale is destined to replace liquid from petroleum.

Subsequent to the cracking and desulfurization, the cleaned $H_2$ rich gas leaves the bottom of cracker/desulfurizer 30 via conduit 70 and enters into cooler 62, where the $H_2$ rich syngas is split into two streams. One stream is piped via conduit 85 to compressor 26 for underground recycling to pyrolyze the coal by means of a hot recycling gas which had been preheated in recycle gas preheater 15, and the other stream is fed to complex 16 via conduit 72, for synthesis into chemicals or transportation fuels such as gasoline or dimethyl ether by known technologies which are not claimed in the instant invention, the storage of these chemicals or fuels being a tank farm which is denoted by numeral 73.

In describing the operation of Phase 2 after completion of the devolatilization of the coal, reference is still made to FIGS. 1 and 6 except that the gas injection part is not hot $H_2$ rich recycle gas into coal seam 10, but a flue gas containing $N_2$ and $CO_2$ being injected into coal seam 10 which had been converted to hot char during the devolatilization taking place in Phase 1. Such flue gas, originating from power island 17 supplied via conduit 81 and from recycle gas heater 15 supplied via flue exhaust 82, forms a combined greenhouse flue gas containing $N_2+CO_2$ to be reacted with the underground residual hot char. This combined flue gas is exhausted by turbo-blower 74 and directed via conduit directional valve 75 in combination with proportional valve 76 controlling the air input into the flue gas to become a gas made up of $(N_2+CO_2)$+ air that flows into conduit 69 for injection into entry pipe 23. The distribution of this newly formed flue gas into hot char seam 10 is effected by means of pipe 19A inclusive of the air as shown in FIG. 6. It is also possible to inject the flue gas and the air independently into the hot char bed or may take the form of various injection combinations to produce the most efficient result using the hot char as the reductant. The supply of air or oxygen is for the purpose of maintaining the temperature of the char to such a degree that is necessary for converting the $CO_2$ contained in the flue gas into CO and to result in the formation of a fuel gas according to the following chemical reaction:

$$N_2+CO_2(\text{flue gas})+C(\text{hot char})\rightarrow N_2+2CO.$$

$N_2+2CO$ is a useful fuel gas or chemical and is herein characterized as a lean gas or a producer gas. This lean gas is extracted by exhauster 27 and pump 28 and delivered to the above-ground hot gas cleanup-upgrader 12A, shown in FIG. 5, wherein treatment is carried out in vessel 30A and discharged as a clean, treated lean gas from the bottom of vessel 30A via bi-directional valve 77 into duct 78 shown in FIG. 1. As shown in FIG. 6, valve 77 is made up of a dual set of secondary valves denoted by numerals 66, and 67 which are adapted to direct gas by means of secondary valve 66 with respect to injection of $H_2$ rich recycle gas or secondary valve 67 with respect to injection of flue gas.

Referring back to FIG. 1, the clean lean gas leaving the bottom of vessel 30A is bifurcated into stream 79 and 80, with stream 79 feeding lean gas as a fuel to gas turbine 51 for the generation of electric power preferably via the combined cycle mode as shown, and with stream 80 feeding clean lean gas as a feedstock-to cyanogen complex 13, and thence to fertilizer maker 14 as previously described. Before stream 79 feeds lean gas to turbine 51, a side stream is taken from it, forming stream 97 which provides lean gas to burner 58 of recycle heater 15. The described approach thus makes use of flue gas $(N_2+CO_2)$ which is a waste gas and characterized as a greenhouse gas, into valuable by-products: namely, clean and efficient electric power; clean gas to heat a recycling gas to effect devolatilization of the resource to produce a $H_2$ rich gas which is most useful in the production of chemicals and/or transport fuels; and badly needed, low-cost fertilizer to grow food and reforest our planet.

With respect to using the instant method for the extraction of energy from oil sands, a low-temperature $H_2$ rich recycle gas is used in order to maximize the conversion of the bitumen to a liquid and minimize its conversion into gases, as the objective is to replace crude oil from petroleum as much as possible.

In conclusion, the method herein disclosed offers an efficient, novel, and useful process for the recovery of energy from underground resources in-situ, and upgrading such energy above ground while converting greenhouse gases such as $CO_2$ into CO underground by reacting the $CO_2$ with hot char.

We claim:

1. A method for the recovery of products from an underground energy resource in the form of coal, shale, or oil sands wherein a hot gas devoid of oxygen is used to pyrolyze underground coal at high temperature, shale at intermediate temperature, and oil sands at low temperature, comprising the following steps:

injecting the hot gas which has been heated above ground into the underground energy resource to pyrolyze the underground energy source and cause the release from said resource raw gases and liquids with high hydrogen content, while producing in-situ hot residual carbon as a result of the pyrolyzation of said resource;

extracting said raw gases and liquids from the underground, together with said hot gas which had been heated above ground, in such a way as to bring a mixture of raw gases and liquids to the surface above ground without degrading said raw gases and liquids, while leaving behind said hot residual carbon in the underground;

subjecting said mixture of raw gases and liquids to a cleanup above ground to produce a clean mixture of gases and liquids;

processing said clean mixture of gases and liquids above ground to co-produce clean chemicals, clean fuels, and clean electric power.

2. The method as set forth in claim 1 wherein the step of injecting a hot gas which has been heated above ground is further characterized by the step of being injected at such a pressure as to increase the efficiency of conducting the pyrolysis of said energy resource.

3. The method as set forth in claim 1 wherein the step of injecting a hot gas is further characterized by said gas being a $H_2$ rich gas to prevent the degradation of said raw gases and liquids.

4. The method as set forth in claim 3 wherein said $H_2$ rich gas is super-heated above ground prior to its injection underground, to a higher temperature of devolatilization of said resource when said $H_2$ rich gas comes in contact with said underground resource in order to efficiently cause the release of volatile matter contained in said resource.

5. The method as set forth in claim 1 wherein the step of injecting a hot gas is further characterized by said gas being devoid of steam to prevent the contamination of water when such steam condenses into water.

6. The method as set forth in claim 1 wherein the step of subjecting said mixture of raw gases and liquids to a cleanup includes the cracking and desulfurization above ground of said mixture to become an upgraded $H_2$ rich synthetic gas which is characterized as a clean $H_2$ rich "syngas."

7. The method as set forth in claim 6 wherein said clean $H_2$ rich syngas is divided into two parts: the first part serves as a recycle gas and the second serves as a feedstock to produce chemicals and/or transportation fuels.

8. The method as set forth in claim 1 wherein the step of processing said clean mixture of gases and liquids above ground to co-produce clean chemicals, clean fuels, and clean electric power is further characterized by the step of generating above ground carbon dioxide ($CO_2$), a greenhouse gas which is suspected to contribute to climate change, during the co-production of said chemicals, fuels, and electric power.

9. The method as set forth in claim 8 wherein the step of generating above ground $CO_2$ is further characterized by injecting said $CO_2$ underground, subsequently to the pyrolysis step of said energy resource, to cause the reacting of said $CO_2$ with said hot residual carbon to convert the $CO_2$ to 2CO, with the result of obviating the costly need of capturing the $CO_2$, transporting it and storing it in a deep geologic formation which would require continuous monitoring.

10. The method as set forth in claim 9 wherein the step of reacting said $CO_2$ with said hot residual carbon is further characterized by the step of providing means to maintain the temperature of said residual carbon at such a level to compensate for the inherent endothermic drop in temperature to insure the continuity of the reaction of the $CO_2$ with said hot residual carbon to produce the 2CO.

11. The method as set forth in claim 10 wherein the step of providing means to maintain the temperature of said residual carbon comprises the inclusion of a controlled amount of air to said $CO_2$, subsequent to the pyrolysis of said resource, to such a degree as to produce in-situ a suppressed combustion reducing condition.

12. The method as set forth in claim 10 wherein the 2CO so produced is extracted together with other gases from underground to above ground, cleaned, and divided into two streams, the first of which being used as a superior fuel in the form of a clean lean gas to efficiently generate electric power, and the second stream being used as a clean chemical feedstock.

13. The method as set forth in claim 12 wherein the step to efficiently generate electric power comprises the use of the combined cycle mode of generating electric power.

14. The method as set forth in claim 12 wherein the step of the second stream being used as a clean chemical feedstock is further characterized by said feedstock being utilized to produce cyanogen ($C_2N_2$).

15. The method as set forth in claim 14 wherein said feedstock being utilized to produce $C_2N_2$ is further characterized by converting said $C_2N_2$ to a fertilizer.

16. The method as set forth in claim 15 wherein said fertilizer is characterized as oxamide $(CONH_2)_2$, a slow-release fertilizer.

17. The method as set forth in claim 1 wherein the step of processing said clean mixture of gases and liquids above ground to co-produce clean chemicals, clean fuels, and clean electric power is further characterized by said chemicals serving as a feedstock.

18. The method as set forth in claim 17 wherein said feedstock is converted to methanol.

19. The method as set forth in claim 18 wherein said methanol is converted to gasoline.

20. The method as set forth in claim 18 wherein said methanol is converted to dimethyl ether (DME), a clean substitute for diesel.

* * * * *